US005743033A

United States Patent [19]

Gegel

[11] Patent Number: 5,743,033

[45] Date of Patent: Apr. 28, 1998

[54] EARTHWORKING MACHINE GROUND ENGAGING TOOLS HAVING CAST-IN-PLACE ABRASION AND IMPACT RESISTANT METAL MATRIX COMPOSITE COMPONENTS

[75] Inventor: Gerald A. Gegel, Morton, Ill.

[73] Assignee: Caterpillar Inc., Peoria, Ill.

[21] Appl. No.: 608,804

[22] Filed: Feb. 29, 1996

[51] Int. Cl.[6] ..... E02F 3/00

[52] U.S. Cl. ..... 37/460; 37/446; 76/108.2

[58] Field of Search ..... 37/460, 451, 465, 37/446; 172/747; 175/425, 374; 76/108.2, 158.1

[56] References Cited

U.S. PATENT DOCUMENTS

| | | | |
|---|---|---|---|
| 1,922,917 | 8/1933 | Russell et al. | 37/460 X |
| 3,145,790 | 8/1964 | Bridwell et al. | 175/425 |
| 3,514,830 | 6/1970 | Takakita et al. | 37/460 X |
| 3,766,354 | 10/1973 | Bierwith | 37/460 X |
| 3,882,594 | 5/1975 | Jackson et al. | 37/460 X |
| 4,011,051 | 3/1977 | Helton et al. | 37/460 X |
| 4,452,325 | 6/1984 | Radd et al. | 175/374 X |
| 4,562,892 | 1/1986 | Ecer | 175/425 X |
| 4,592,252 | 6/1986 | Ecer | 76/108.2 |
| 4,597,456 | 7/1986 | Ecer | 76/108.2 X |
| 4,630,692 | 12/1986 | Ecer | 175/374 X |
| 4,715,450 | 12/1987 | Hallissy et al. | 37/460 X |
| 4,949,598 | 8/1990 | Griffin | 76/108.2 |
| 5,205,684 | 4/1993 | Meskin et al. | 175/374 X |
| 5,322,109 | 6/1994 | Cornie | 164/97 |
| 5,427,186 | 6/1995 | Adrian et al. | 37/460 X |
| 5,544,550 | 8/1996 | Smith | 76/108.1 |

*Primary Examiner*—Terry Lee Melius
*Assistant Examiner*—Thomas A. Beach
*Attorney, Agent, or Firm*—Pankaj M. Khosla

[57] ABSTRACT

A ground engaging tool for an earthworking machine comprises a ground engaging element with a cast-in-place metal matrix composite component. The ground engaging element comprises a metal base component and a metal matrix composite component. The metal matrix component is bonded to the metal base component. The metal matrix composite component consists of a preform having interconnecting porosity. The preform is formed from a material selected from one of ceramic, cermet, or mixtures thereof. The metal matrix composite component also consists of an infiltration metal. The preform is infiltrated by the infiltration metal and the infiltration metal is fusion bonded to the metal base component.

22 Claims, 3 Drawing Sheets

EARTHWORKING MACHINE GROUND ENGAGING TOOLS HAVING CAST-IN-PLACE ABRASION AND IMPACT RESISTANT METAL MATRIX COMPOSITE COMPONENTS

TECHNICAL FIELD

The present invention relates generally to ground engaging tools for earthworking machines, and more particularly to ground engaging tools having cast-in-place metal matrix composite components which result in improved abrasion and impact resistance.

BACKGROUND ART

The earthworking machinery industry has for years experienced the daunting problem of designing ground engaging tools that have a combination of abrasion resistance and impact resistance. High wear resistance is achieved by increased hardness of the component while high impact strength is attained by increasing the fracture toughness of the component. It is well known in the industry that the useful life of a cutting edge or cutting bit of a ground engaging component is increased if it has a combination of both wear and impact resistance. For example, equipment such as excavation teeth, excavation blades, mining plows, grading blades, impact blades and the like, which engage the ground, require both high wear resistance and fracture toughness.

In the past, composite materials have been developed which exhibit improved wear and impact resistance. For example, U.S. Pat. No. 4,119,459 issued to Ekemar et. al discloses the preparation of a metallic body which includes sintered cemented carbide particles in a matrix of cast iron. The cast iron may be normal gray cast iron and graphitic cast iron treated in various ways. The treating process may include inoculation or heat treatment of the cast iron with nodular iron, i.e., cast iron with nodular or ball-shape graphite being preferred for some applications.

U.S. Pat. No. 4,099,998 issued to Horiuchi et al. discloses a composite material produced by placing a plurality of blocks of cast iron having high wear-resisting properties on the bottom of a mold and pouring into the mold, a molten impact resistant cast steel. The composite material is reported to exhibit both wear and impact resistance properties.

U.S. Pat. No. 4,187,626 issued to Greer et al. discloses the preparation of excavating tools having hard-faced elements in the material engaging surfaces thereof. The hard-faced elements have generally planar faces that are disposed at an angle to the ground engaging surface. Such excavating tools include excavating teeth, excavating blades and cutting edges employed on underground mining plows. The hard surface material comprises sintered metal carbides such as tungsten carbide dispersed in a cobalt matrix.

Researchers at the National Bureau of Mines have placed hard particles on the bottom surface of a mold and poured cast molten metal around them. They employ the "lost foam" casting technique where a hard particle paste is placed on the surface of a polystyrene pattern which is then placed into a sand mold. During the casting process, the molten metal replaces the polystyrene and infiltrates the hard particle paste to create a part with a wear resistant surface.

Researchers at Caterpillar Inc., the assignee of the present invention, have developed composite materials having a combination of impact and wear resisting surfaces. One composite material includes a base member of austempered ductile iron and a plurality of hard particles such as tungsten carbide imbedded in the base member. The composite material may be prepared in a variety of ways. One way is to place the tungsten carbide particles into a mold and pour iron around them. The metal is solidified by cooling and then austempered. Another way is to place hard inserts made from a hard paste of tungsten carbide on the surfaces of a polystyrene foam pattern. The foam pattern is placed in a sand mold and during casting, the iron replaces the polystyrene and infiltrates the hard particle paste. The iron is solidified and then the composite is austempered.

Other methods developed at Caterpillar Inc. include techniques where abrasion resistant materials are welded onto a surface of, or into cavities in, the metal base comprising the ground engaging tool. Although the foregoing techniques have been very successful, there is a desire to continuously improve the wear and impact resistance of such components used for making ground engaging tools to enhance quality and remain competitive in the global marketplace.

It has been desirable to have ground engaging tools that have cast-in-place hard edged materials that impart a combination of wear and impact resistance properties. It has further been desirable to improve the integrity of the bond between the base metal used to form the bulk of the ground engaging tool and the hard wear and impact resistant material cast into the base metal.

The present invention is directed to overcome one or more problems of heretofore utilized ground engaging tool assemblies for the earthworking machinery industry.

DISCLOSURE OF THE INVENTION

In one aspect of the present invention, a ground engaging tool for an earthworking machine is disclosed. The ground engaging tool comprises a ground engaging element with a cast-in-place metal matrix composite component. The ground engaging element comprises a metallic base component of preselected dimensions, and a metal matrix composite component. The metal matrix component has preselected dimensions and is bonded to the metal base component. The metal matrix composite component consists of a preform having interconnecting porosity, and having preselected dimensions. The preform is formed from a material selected from one of ceramic, cermet, or mixtures thereof. The metal matrix composite component also consists of an infiltration metal. The porosity of the preform is infiltrated by the infiltration metal. The infiltration metal is fusion bonded to the metal base component.

BEST MODE FOR CARRYING OF THE INVENTION

Figure 1:
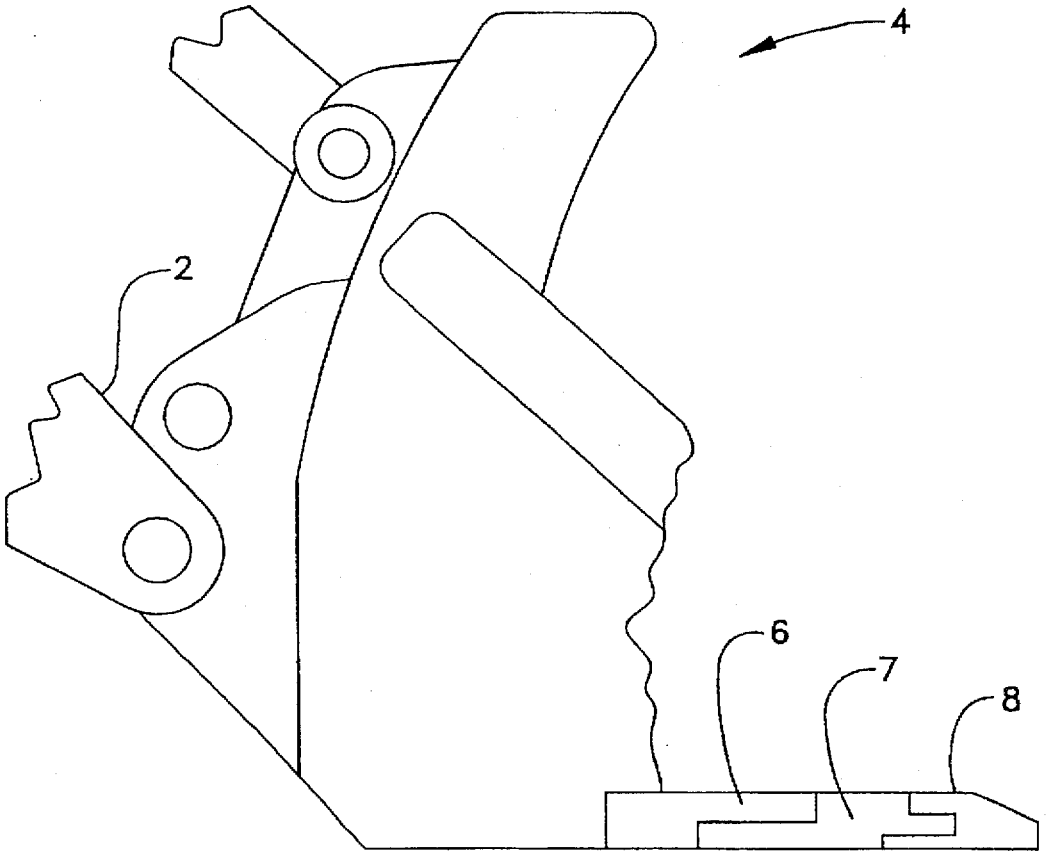
FIG. 1 is a diagrammatic partial side view of a ground engaging tool for an earthworking machine having a ground engaging element which has a cast-in-place metal matrix composite component, according to one embodiment of the present invention.
Figure 2:
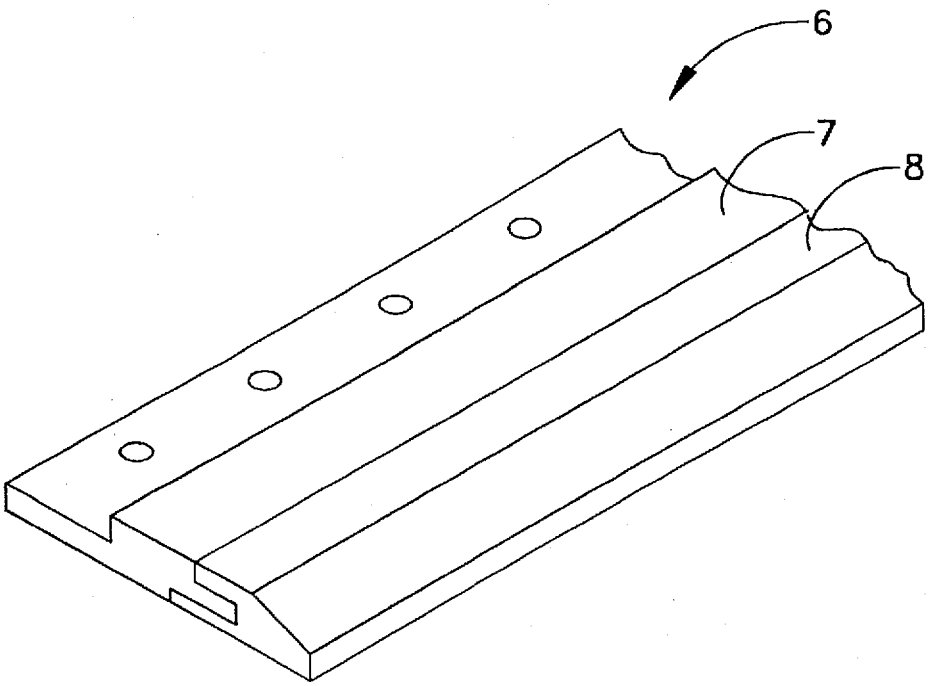
FIG. 2 is a diagrammatic view of a ground engaging element of FIG. 1 which has a cast-in-place metal matrix composite component according to one embodiment of the present invention.
Figure 3:
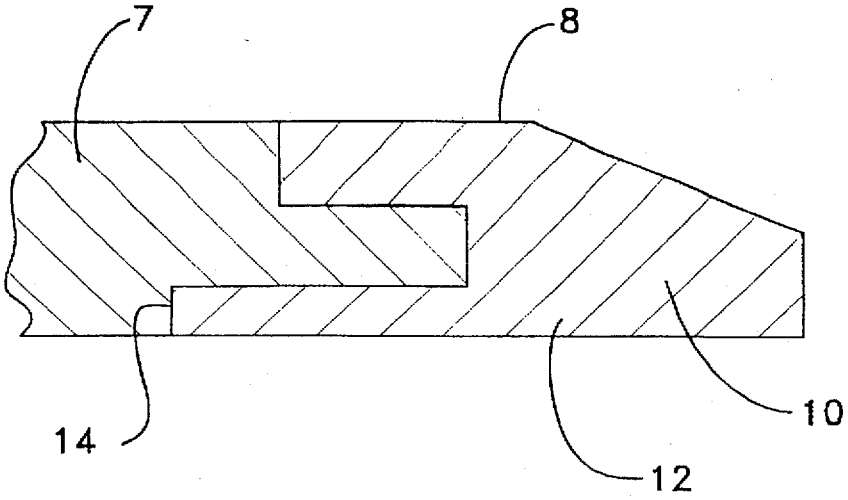
FIG. 3 is a diagrammatic view in cross section of the ground engaging element of FIG. 2.

Referring to FIG. 1, an earthworking machine 2, for example, a motor grader or loader has a blade or bucket 4 which has a ground engaging element 6 having a cast-in-place metal matrix composite component 8. The ground engaging element 6 comprises a metal base component 7 of preselected dimensions, and the metal matrix composite component 8 of preselected dimensions, which is bonded to the metal base component as shown in FIG. 2. Referring to FIG. 3, the metal matrix composite component 8 consists of a preform 10 having an interconnecting porosity. The preform 10 is formed from a material selected from one of ceramic, cermet, or mixtures thereof. The metal matrix composite component 8 also consists of an infiltration metal 12. The porosity of preform 10 is infiltrated by the infiltration metal 12. The infiltration metal 12 is fusion bonded to the metal base component 7 at the fusion interface 14.

Figure 4:
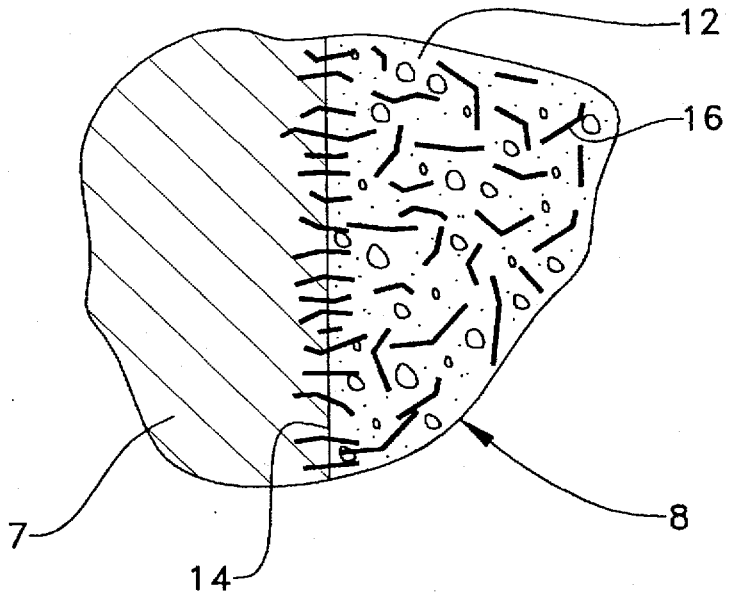
FIG. 4 is a magnified view of the fusion interface between the metal base and the metal matrix component, showing the interconnected porosity having been infiltrated with the infiltration metal, which in turn, is fused with the metal base.

As shown in FIG. 4, infiltration metal 12 infiltrates the interconnecting porosity 16 of metal matrix component 8.

As used in this description and in the claims, the term "preform" refers to a porous body which can include fibers, whiskers, particulates and a porous pack which acts as a reinforcement phase which can be subsequently infiltrated by a metal to form a infiltrated preform.

As used herein, the term "infiltration" refers to the injection under pressure of a molten liquid. The molten infiltrate charge which can be a molten metal, a metal alloy or an intermetallic compound infiltrates into the preform under pressure.

The term "bonded" as used herein means any method of attachment between two bodies. The attachment may be physical, and/or chemical and/or mechanical. A physical attachment requires that at least one of the two bodies, usually in a liquid state, infiltrate at least a portion of the microstructure of the other body. This phenomenon is commonly known as "wetting". A chemical attachment requires that at least one of the two bodies chemically react with the other body to form at least one chemical bond between the two bodies. A mechanical attachment between two bodies includes a macroscopic infiltration of at least one of the two bodies into the interior of the other body. One example of mechanical attachment would be the infiltration of at least one of the two bodies into a groove or a slot on the surface of the other body. Such mechanical attachment does not include microscopic infiltration or wetting.

The term "fusion-bonding", as used herein, means a chemical attachment between the two bodies. This attachment occurs when the two bodies chemically react with each other and the two bodies are in a semi-molten state, especially at the interface, such that there is a weld formation at the interface where one body meets the other. The term "fusion bonding" as used herein does not mean physical and/or mechanical attachment but is rather a form of chemical bonding.

The term "metal matrix composite", as used herein, means a porous reinforcement preform used to form a metal matrix composite body wherein the porous reinforcement preform is infiltrated by an infiltration metal. The metal matrix composite has two or more physically and/or chemically distinct, suitably arranged or distributed components, and exhibits improved property characteristics that are not exhibited by any of the components in isolation. For example, a metallic component is reinforced by a ceramic or cermet component to form a metal matrix composite.

The term "interconnecting porosity", as used herein, means that the preform has a porous structure and the pores do not exist in isolation but rather, they are connected to one another to form interconnecting porous channels. These channels facilitate the infiltration of the infiltration metal into the preform.

The term "cermet" as used herein, describes a type of material that includes a ceramic component and a metal component. Examples of cermets include metal and ceramic carbides, such as for example, tungsten carbide, titanium carbide and cobalt.

In the preferred embodiment of the present invention, the base metal is one of cast iron or alloy steel. Preferably, the base metal base is an alloy steel. The alloy steel, in one embodiment, has a composition by weight percent comprising 0.22 to 0.29 carbon, 1.2 to 1.5 manganese no greater than 0.04 phosphorous and no greater 0.05 sulfur and balance iron. The alloy steel, in another embodiment, has a composition by weight percent comprising 0.36 to 0.40 carbon, 0.7 to 1.00 manganese, 0.15 to 0.3 silicon, 0.8 to 1.15 chromium, 0.15 to 0.25 molybdenum, no greater than 0.035 phosphorous, no greater than 0.04 sulfur and balance iron.

In the preferred embodiment of the present invention, the metal matrix composite is bonded to the metallic base component by at least a chemical bond. Desirably, the metal matrix composite is bonded to the metallic base component by a combination of a chemical bond and one of physical bond, mechanical bonds, or a combination thereof. A physical bond is attained by partial encapsulation of the metal matrix composite by the metal base component by a pressure infiltration process as described hereunder.

In the preferred embodiment of the present invention, the preform has a configuration of one of a porous pack, particulates, tubules platelets, pellets, spheres, fibers, a woven mat, whiskers and mixtures thereof. Preferably, the preform has a configuration of particulates.

In the preferred embodiment of the present invention, the preform is formed from aluminum oxide particulates having a particle size in the range of 20 to 30 mesh. A particle size larger than 20 mesh size is undesirable because the packing density would be too low and the desired total porosity of the wear resistant preform will not be attained within the range of about 40% to about 60%. A particle size smaller than 30 mesh is undesirable because the packing density would be too high and the desired total porosity of the wear resistant preform will be less than about 40%. This will detrimentally reduce wear resistance of the resultant metal matrix composite.

In the preferred embodiment of the present invention, the ceramic material is at least one ceramic material desirably selected from the group consisting of titanium carbide, aluminum oxide, titanium diboride and tungsten carbide. Preferably, the ceramic material is aluminum oxide.

Alternatively, the preform may also be made from ceramic materials selected from yttrium oxide, boron nitride, zirconium carbide, hafnium carbide, zirconium nitride, hafnium nitride, and diamond particulates.

In the preferred embodiment of the present invention, the cermet material is at least one cermet material desirably formed from (a) ceramic materials selected from the group consisting of titanium carbide, chromium carbide, titanium diboride and tungsten carbide, and (b) metallic materials selected from the group consisting of molybdenum, cobalt, tungsten, chromium, niobium and tantalum, or mixtures thereof. Preferably, the cermet is tungsten carbide and cobalt.

In the preferred embodiment of the present invention, the infiltration metal is desirably at least one of iron, alloy steel or mixtures thereof, and preferably, one of iron or alloy steel or mixtures thereof. In the preferred embodiment, the infiltration metal is an alloy steel, having a composition by weight percent comprising 0.36 to 0.44 carbon, 0.7 to 1.00 manganese, 0.15 to 0.3 silicon, 0.8 to 1.15 chromium, 0.15 to 0.25 molybdenum, no greater than 0.035 phosphorous, no greater than 0.04 sulfur and balance iron. The above composition is characteristic of an AISI 4140 steel. In yet another preferred embodiment, the infiltration metal is an alloy steel, having a composition by weight percent comprising 0.25 to 0.32 carbon, 0.50 to 0.90 manganese, 1.40 to 1.80 silicon, 1.60 to 2.00 chromium, no greater than 0.50 nickel, 0.30 to 0.40 molybdenum, no greater than 0.035 phosphorous, no greater than 0.04 sulphur, no greater than 0.15 copper, no greater than 0.03 aluminum, no greater than 0.02 vanadium, 0.025 to 0.04 zirconium, and balance iron.

Desirably, the infiltration metal has a melting temperature at least equal to or greater than the melting temperature of the metal base, and preferably, a melting temperature at least equal to or greater than that of the base metal. The infiltrating metal melting temperature being equal to or greater than that of the base metal causes the weld formation at the interface which is critical to obtaining a high bond strength. However, it should be noted that one skilled in the art may employ dissimilar metals for the infiltration and base metals, as long as the fusion bond integrity is not detrimentally affected.

In the preferred embodiment, the infiltration metal is fusion bonded to the base metal by the formation of a weld between the two metals at the interface, called the fusion interface. A fusion bond is the preferred method of attachment in order for the resultant metal matrix composite to withstand the rigorous wear and impact duty application, such as for example, a ground engaging tool.

In the preferred embodiment of the present invention, the preform, prior to being infiltrated by the infiltration metal, desirably has a total porosity in the range of about 40% to about 60% out of which, the interconnecting porosity is desirably at least 90% of total porosity, and preferably, at least 98% of the total porosity. A total porosity less than 40% is undesirable because there will not be enough infiltrant metal phase to obtain a high impact resistance. A total porosity greater than 60% is undesirable because there will not be enough reinforcement preform material to obtain a high wear resistance. A porosity in the range of about 40% and about 60% represents a compromise between the desired wear resistance and impact resistance of the metal matrix composite. An interconnecting porosity less than 90% of total porosity is undesirable because it will detrimentally result in insufficient infiltration of the preform by the infiltration metal, thus reducing wear and impact resistance.

In the preferred embodiment of the present invention, the preform, after being infiltrated by the infiltration metal, has a final porosity desirably no greater than 2% and preferably, no greater than 0.5%. A final porosity greater than 2% is undesirable because it will reduce the strength and impact resistance of the metal matrix composite component.

A ground engaging tool, such as a bucket edge for a dozer having a cast-in-place abrasion and impact resistant metal matrix composite component is prepared by a pressure infiltration process in the following manner, as shown in Example A, according to the preferred embodiment of the present invention.

EXAMPLE A

The base metal selected is an AISI 1527 steel having the following composition by weight:

| | |
|---|---|
| carbon | 0.22% to 0.29% |
| manganese | 1.20% to 1.50% |
| phosphorous | 0.04% max. |
| sulphur | 0.05% max. |
| iron | balance. |

The infiltration metal selected is an AISI 4140 steel having the following composition by weight:

| | |
|---|---|
| carbon | 0.36% to 0.44% |
| manganese | 0.70% to 1.00% |
| silicon | 0.15% to 0.30% |
| chromium | 0.80% to 1.15% |
| molybdenum | 0.15% to 0.25% |
| phosphorous | 0.035% max. |
| sulphur | 0.04% max. |
| iron | balance. |

The material for the preform is aluminum oxide in a particulate form. The alumina particles have a mesh size in the range of about 20 to 30.

The steel alloy AISI 1527 for making the metallic base component of the ground engaging element is placed within a first mold, which has heating elements on the side walls and cooling elements at the bottom. The first mold is preheated to a temperature of about 2642° F. The first mold temperature is maintained during this preheating stage in the range of about 2630° F. to about 2650° F. A second mold, also having heating elements, is placed on the top of the first mold and the two molds are held together by clamping means. Alumina particles are poured into the cavity created by the combination of the first and second molds.

A filter pad made from materials such as alumina is placed on the top of the alumina particles. The filter pad has a porosity in the range of about 25% to 85%. The infiltration metal is then placed on the top of the filter. The second mold is preheated to a temperature of about 2825° F. The second mold temperature is maintained during this heating stage in the range of about 2775° F. to about 2875° F. The infiltration metal, i.e., AISI 4140 steel is melted and becomes the infiltration charge. A vacuum of about 600 mm Hg is maintained in the alumina preform via a tube inserted into the filter pad and connected at the other end to a vacuum pump. The entire apparatus is placed in a pressure vessel and pressurized to a pressure of about 1500 psig. The molten steel alloy infiltrates the alumina preform and causes local melt formation of the alloy steel of the base component. A fusion bonding of the infiltrant metal and the base metal occurs with accompanying physical and mechanical interlocking of the alumina preform in the melt at the interface.

Industrial Applicability

The present invention is particularly useful to the construction, mining and earthworking equipment industry for making ground engaging elements for abrasion and impact duty applications. In typical abrasion duty applications, both penetration and wear resistance are required, such as for dozing clay, loam, silt, sand, and gravel. In typical impact duty applications, more fracture strength is required, such as for dozing blasted rock, slabs and boulders in a mining environment.

This invention is particularly useful for making impact and wear resistant components for tools such as a profiler shank and cutting edges for various earthworking machines such as motor graders, dozers, excavator buckets, wheel loader buckets, front shovel buckets and scrapers. Other applications include dozer end bits and compacter feet, including chopper blades and plus tips for landfill applications. Yet other applications include bucket tips for wheel loaders, dozers, excavators, front shovels and backhoe loader buckets.

Other aspects, objects and advantages of this invention can be obtained from a study of the drawings, the disclosure and the appended claims.

I claim:

1. A ground engaging tool for an earthworking machine, comprising:

a ground engaging element having a cast-in-place metal matrix composite component, the ground engaging element comprising, a metal base component of preselected dimensions, a metal matrix composite component of preselected dimensions being bonded to said metal base component, said metal matrix composite component consisting of, a preform having interconnecting porosity, and of preselected dimensions, and being formed from a material selected from one of ceramic, cermet, or mixtures thereof, an infiltration metal, said porosity of said preform being infiltrated by said infiltration metal, said infiltration metal being fusion bonded to said metal base component, said preform, prior to being infiltrated by said infiltration metal, has a total porosity out of which, said interconnecting porosity is at least 90% of said total porosity.

2. A ground engaging tool, as set forth in claim 1, wherein said base metal is one of carbon steel or alloy steel.

3. A ground engaging tool, as set forth in claim 2, wherein said base metal is an alloy steel.

4. A ground engaging tool, as set forth in claim 3, wherein said alloy steel has a composition by weight %, comprising, 0.22 to 0.29 carbon, 1.20 to 1.50 manganese, no greater than 0.04 phosphorous, no greater than 0.05 sulphur, and balance iron.

5. A ground engaging tool, as set forth in claim 3, wherein said alloy steel has a composition by weight %, comprising, 0.36 to 0.44 carbon, 0.70 to 1.00 manganese, 0.15 to 0.30 silicon, 0.80 to 1.15 chromium, 0.15 to 0.25 molybdenum, no greater than 0.035 phosphorous, no greater than 0.04 sulphur, and balance iron.

6. A ground engaging tool, as set forth in claim 1, wherein said metal matrix composite component is bonded to said metal base component by at least a chemical bond.

7. A ground engaging tool, as set forth in claim 6, wherein said metal matrix composite component is bonded to said metal base component by a combination of (a) a chemical bond and (b) one of physical bond, mechanical bond, or a combination thereof.

8. A ground engaging tool, as set forth in claim 1, wherein said preform has the configuration of one of a porous pack, particulates, tubules, platelets, pellets, spheres, fibers, woven mat, whiskers and mixtures thereof.

9. A ground engaging tool, as set forth in claim 1, wherein said preform, prior to being infiltrated by said infiltration metal, has said total porosity in a range of about 40% to about 60%.

10. A ground engaging tool, as set forth in claim 9, wherein said interconnecting porosity is at least 98% of the total porosity.

11. A ground engaging tool, as set forth in claim 9, wherein said preform, prior to being infiltrated by said infiltration metal, has a total porosity in the range of about 45% to about 50%.

12. A ground engaging tool, as set forth in claim 1, wherein said ceramic material is at least one ceramic material selected from the group consisting of titanium carbide, aluminum oxide, titanium diboride and tungsten carbide.

13. A ground engaging tool, as set forth in claim 12, wherein said ceramic material is aluminum oxide.

14. A ground engaging tool, as set forth in claim 1, wherein said cermet material is at least one cermet material formed from (a) ceramic materials selected from the group consisting of titanium carbide, aluminum oxide, titanium diboride and tungsten carbide, and (b) metallic materials selected from the group consisting of molybdenum, cobalt, tungsten, chromium, niobium and tantalum, or mixtures thereof.

15. A ground engaging tool, as set forth in claim 1, wherein said infiltration metal is at least one of iron, an alloy steel or mixtures thereof.

16. A ground engaging tool, as set forth in claim 15, wherein said infiltration metal is an alloy steel.

17. A ground engaging tool, as set forth in claim 16, wherein said alloy steel has a composition by weight %, comprising, 0.36 to 0.44 carbon, 0.70 to 1.00 manganese, 0.15 to 0.30 silicon, 0.80 to 1.15 chromium, 0.15 to 0.25 molybdenum, no greater than 0.035 phosphorous, no greater than 0.04 sulphur, and balance iron.

18. A ground engaging tool, as set forth in claim 16, wherein said alloy steel has a composition by weight %, comprising, 0.25 to 0.32 carbon, 0.50 to 0.90 manganese, 1.40 to 1.80 silicon, 1.60 to 2.00 chromium, no greater than 0.50 nickel, 0.30 to 0.40 molybdenum, no greater than 0.035 phosphorous, no greater than 0.04 sulphur, no greater than 0.15 copper, no greater than 0.03 aluminum, no greater than 0.02 vanadium, 0.025 to 0.04 zirconium, and balance iron.

19. A ground engaging tool, as set forth in claim 1, wherein said preform, after being infiltrated by said infiltration metal, has a final porosity no greater than 2%.

20. A ground engaging tool, as set forth in claim 1, wherein said infiltration metal has a melting temperature at least equal to or greater than the melting temperature of said base metal.

21. A ground engaging tool, as set forth in claim 20, wherein said infiltration metal has a melting temperature in the range of about x °F. to about (x+50) °F., where x is the melting temperature of said base metal.

22. A ground engaging tool, as set forth in claim 1, wherein said infiltration metal is fusion bonded to said metal base component by a weld formation.

* * * * *